US010758093B2

(12) United States Patent
Ruiz Perez et al.

(10) Patent No.: US 10,758,093 B2
(45) Date of Patent: Sep. 1, 2020

(54) DEVICE FOR CONNECTING A WATERPROOFING TO A BUILT-IN SHOWER DRAIN AND A WATERPROOFING ASSEMBLY

(71) Applicant: Estil Guru S.L., Ontinyent (ES)

(72) Inventors: Francisco Javier Ruiz Perez, Ontinyent (ES); Francisco Ferrandiz Gisbert, Ontinyent (ES)

(73) Assignee: Estil Guru S.L., Ontinyent (ES)

( * ) Notice: Subject to any disclaimer, the term of this patent is extended or adjusted under 35 U.S.C. 154(b) by 135 days.

(21) Appl. No.: 15/475,428

(22) Filed: Mar. 31, 2017

(65) Prior Publication Data

US 2018/0279840 A1 Oct. 4, 2018

(51) Int. Cl.
*A47K 3/40* (2006.01)
*E03F 5/04* (2006.01)

(52) U.S. Cl.
CPC ..... *A47K 3/40* (2013.01); *E03F 5/0408* (2013.01); *E03F 5/0409* (2013.01)

(58) Field of Classification Search
CPC ..... E03D 1/38; E03D 11/16–17; E03F 2005/0413; E03F 5/0408–0409; A47K 3/40; A47K 3/405
USPC ..... 4/292, 612, 613, 695; 52/302.1, 302.6
See application file for complete search history.

(56) References Cited

U.S. PATENT DOCUMENTS 4,943,100 A * 7/1990 Emberson ..... E03F 5/0407 210/164
5,022,430 A * 6/1991 Degooyer ..... E03F 5/0407 137/362
6,076,559 A * 6/2000 Castillo ..... E03F 5/04 138/89
7,632,401 B2 * 12/2009 Edelmayer ..... E03F 5/0407 210/164
7,814,580 B2 * 10/2010 Coronado ..... E03D 11/16 4/252.6
7,841,580 B2 * 11/2010 Konishi ..... F16L 37/40 251/149.1
8,230,535 B2 * 7/2012 Kik, Sr. ..... A47K 3/40 4/613
9,790,693 B2 * 10/2017 Wilde ..... E04F 21/24
2013/0160203 A1 * 6/2013 DeGooyer ..... E03F 5/0408 4/679
2014/0131996 A1 * 5/2014 Murphy ..... E03F 5/0409 285/136.1
2014/0317841 A1 * 10/2014 DeJesus ..... A47K 3/40 4/613

* cited by examiner

*Primary Examiner* — David P Angwin
*Assistant Examiner* — Nicholas A Ros

(57) ABSTRACT

An adaptive device for connecting a waterproofing to a built-in shower drain, said built-in drain comprising a drain body mountable in a clamping ring, which comprises a body made up of an upper section and a lower section with a through hole, in parallel arrangement at different levels, the upper and lower sections joined together by means of a deformable intermediate section which is capable of folding by means of at least one fold line. This device provides a global constructive system for built-in showers, greater versatility and adaptability to different thicknesses and layers of materials which may be used in the construction of a shower.

14 Claims, 10 Drawing Sheets

DEVICE FOR CONNECTING A WATERPROOFING TO A BUILT-IN SHOWER DRAIN AND A WATERPROOFING ASSEMBLY

OBJECT OF THE INVENTION

The object of the present invention relates to a new device for connecting a waterproof sheet on the drain body of a built-in shower.

This device provides a global constructive system for built-in showers, greater versatility and adaptability to different thicknesses and layers of materials which may be used at a construction site with these characteristics.

FIELD AND BACKGROUND OF THE INVENTION

Well known in the state of the art are built-in shower trays (tiled), the construction of which is a common practice in the USA, which involves the need to prepare the drain area on the floor, a sloped base that leads to said drain and waterproofing protection for the entire surface.

In using ceramic coatings or natural stone in moist areas such as showers, it is common for a waterproofing membrane to be installed in order to contain and drain the water, as well as to provide proper protection for construction materials against the effects of the moisture.

In line with the standards and regulations which regulate these types of installations, the waterproofing membrane must slope towards the drain and connect to it, forming a watertight seal. Therefore, properly making the connection between the waterproofing protection and the drain is a determining factor in correctly building a built-in shower that complies with the aforementioned regulatory criteria.

In the traditional way of constructing shower bases, this connection is not very difficult, given that due to the materials used, the membrane and the base for fixing the clamping ring, which comes fixed to the waterproofing on the drain body, can easily be placed so as to remain flush.

Commonly used in a conventional installation is a non-adhesive membrane, on which a thick mortar bed is used as a base to which the ceramic coating or natural stone is adhered, and which is not protected by waterproofing.

Non-adhesive membranes are directly arranged on the floor, or on a thin layer of sloped mortar. The drain must always be connected at the same level as the clamping ring, which is usually at floor level, and in the case that it is above the floor, said point is adjusted simply by varying the thickness of said sloped mortar, thereby achieving the desired leveling of the surface.

By using different construction materials and techniques, significant improvements have been made in the quality and finishes of these types of installations, such as a waterproofing with greater protection applied directly below the tiling by means of adhered membranes, placing the tiles in thin layers, using a substrate of panels to reinforce the installations with less thickness and weight, among other techniques.

However, with these new construction materials and techniques which are combined with traditional construction methods, there is often an unevenness of the elements that interact in said construction, which complicates the connection between the waterproofing membrane and the drain of the installation.

Therefore, with the aim of providing a more complete protection membrane and of not leaving the mortar bed base for tile placement exposed to moisture with each use of the shower, it is necessary to use an adherent-type membrane (according to the provisions in the ANSI A118.10 Standard).

Considering the requirements and restrictions established by the different regulatory codes and standards, the installer will find the following circumstances:

With respect to the floor drain, it must be in accordance with the plumbing codes (and/or in accordance with the ASME A112.18.2 Standard) and must have a clamping ring for connection to the waterproofing, with the aim of mechanically fixing said waterproofing, or it must have a flange integrated as the base for the adherence thereof.

In the case of drains with clamping rings, the drain body is connected to the drain pipe generally below the floor level and is supported and fixed to the surface of the support floor, such that the clamping ring is at the same level.

With regard to the sloped base made of mortar, to ensure a correct drainage of the shower water, the current regulations and codes demand a minimum 2% (¼" per foot [0.63 cm per 30 cm]) slope towards the mouth of the drain in the floor.

The minimum necessary thickness for this layer at its lowest point, joined to the drain, can create a vertical distance from the surface thereof, the level where the adhered membrane is placed, with respect to a hard floor, the level of the clamping ring flange. This height may vary from being practically flush in the case of concrete floors, to being over 3 cm (1¼") in the case of wooden floors, depending on the possible substrates.

Typically, built-in shower drains incorporate systems to adapt to the height of the grate and which can remain flush with the surface of the pavement, but they do not contemplate systems for correcting level differences for connection with waterproofing.

On the market it is common to use drains with incorporated clamping rings in built-in showers, since they are the most extensive and well known in the sector. Also, they are usually the type of drains which are generally found installed in practically all cases in which an installation is being renovated or reformed, which is why the base can still be used and, therefore, it is not necessary to replace it, saving on costs and labor.

Found in the state of the art are shower drains with an integrated flange, to which an adherent-type membrane may be attached, but these are exclusive solutions for models from specific manufacturers, as well as for specific types of grates and finishes. In this case, when it is necessary to renovate or reform an installation, it is usually obligatory to completely substitute the existing drain, which comes with the costs of the replacement parts and labor.

Additionally, also found on the market are pre-manufactured pieces of impermeable sheets which are have different fixed heights, and in which it is necessary to first make the sloped base, then measure the difference in level with the coupling flange of the clamping ring, and at that point check the version that best adjusts to the necessary measurement, which requires a previous study of the construction that is to be carried out, and necessarily results in a delay in achieving the same.

In light of all the foregoing, an element or procedure for the installation which makes the placement of waterproofing on an adhered layer possible, facilitating the connection of the clamping ring, regardless of the level difference due to the thickness of the layers of the installation, and which is also suitable to be used with the majority of built-in shower drain models and trademarks currently found on the market has not been found in the state of the art.

SUMMARY OF THE INVENTION

The present invention has been developed for the purpose of providing an adaptive device which constitutes a novelty in its field of application and resolves the aforementioned drawbacks, also providing other additional advantages that will become evident from the accompanying description below.

Therefore, an object of the present invention is to provide an adaptive device for connecting a waterproofing to a built-in shower drain, said built-in drain comprising a drain body mountable in a clamping ring, which comprises a body made up of an upper section with a through hole and a lower section with a through hole in parallel arrangement at different levels, the upper and lower sections joined together by means of a deformable intermediate section which is capable of folding by means of at least one fold line.

According to another aspect of the invention, the intermediate section of the first element comprises at least three fold lines which are parallel to each other.

Preferably, the body is made up of a laminar material of a waterproofing material of a known type.

Also preferably, the body has the general form of a circular plan.

Another object of the present invention is to provide a waterproofing assembly for a built-in shower drain which comprises:

An upper grate,

A drain body,

A clamping ring arranged between the upper grate and the drain body,

An device arranged to connect a waterproofing to a built-in shower drain, arranged between the upper grate and the drain body, which comprises a body made up of an upper section and a lower section with a through hole in parallel arrangement at different levels, the upper and lower sections joined together by means of a deformable intermediate section which is capable of folding by means of at least one fold line; and A template piece envisaged for being arranged on a clamping ring, which comprises a body of a rigid material which has an upper surface and a lower surface with a central through hole, the surfaces being separable from one another, the upper and lower surfaces joined together by means of an intermediate section, the lower surface having a plurality of protuberances, in which at least one of the protuberances has a through hole, the device and the template piece being axially aligned with respect to a drain body and the clamping ring.

Advantageously, the protuberances of the template piece are arranged in two sets, radially distributed with respect to the central through hole.

In an embodiment, the template piece includes at least a perforated pre-cut line arranged in the peripheral area of the lower section.

In a preferred embodiment, the template piece includes an additional perforated pre-cut line located in the upper section.

In accordance with another characteristic of the invention, the intermediate section of the template piece includes a marking line.

Preferably, each one of the protuberances of a first set of protuberances comprises a through hole.

The lower surface of the template piece has a circular plan.

According to another aspect, the upper surface of the template piece has an essentially quadrangular plan.

According to a preferred embodiment, the clamping ring is coupled to the template piece and the drain body by means of screw elements which pass through protuberances of the template piece.

Other characteristics and advantages of the device and assembly, object of the present invention, will become clear in light of the description of a preferred, though non-exclusive, embodiment, which, by way of a non-limiting example, is illustrated in the accompanying drawings, wherein:

DESCRIPTION OF SPECIFIC EMBODIMENTS OF THE INVENTION

In view of the aforementioned figures and, in accordance with the numbering adopted, an example of a preferred embodiment of the invention can be observed therein, which comprises the parts and elements indicated and described in detail below.

Figure 1:
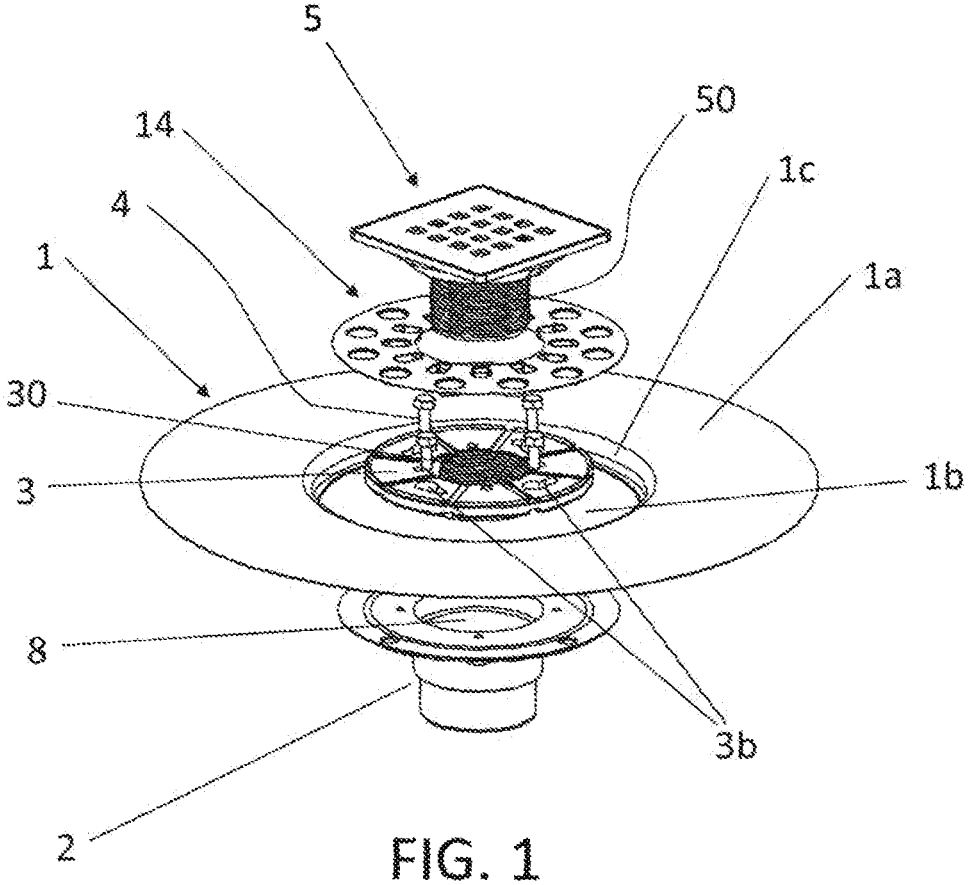
FIG. 1 shows an exploded perspective view of a waterproofing assembly in accordance with the present invention.

As shown in FIG. 1, an embodiment of a waterproofing assembly for a built-in shower drain comprises an upper grate 5 and a drain body 2 with a mouth 8, the drain body 2 located in the lower part of the assembly which is housed in the drainage hole and which allows for the exit of water coming from the shower tray when it is being used to a wastewater treatment plant.

Moreover, the assembly also includes a clamping ring 3 arranged between the upper grate and the drain body, the shape of the body being essentially discoidal. This clamping ring 3 is coupled by means of a threaded section 30 to a threaded section 50 present on an extension which extends below the upper grate 5, as may be seen more clearly in FIGS. 1 and 10.

With the aim of adapting the width of the built-in shower tray structure, an adaptive device 1 is provided, arranged between the upper grate and the drain body, which comprises a body having a very small thickness made of a waterproofing material which is essentially made up of an upper section 1*a* and a lower section 1*b* with a through hole in parallel arrangement at different levels, the upper 1*a* and lower 1*b* sections joined together by means of a deformable intermediate section 1*c* which is capable of folding by means of a plurality of fold lines which run diametrically through the intermediate section 1*c*. These fold lines 7 allow the height of the adaptive device 1 to be modified. It is noteworthy that the through hole on the lower section 1*b* is made once the device is mounted in the built-in shower installation, such that the dimensions of the hole are adapted to the dimensions of the drainage hole on the built-in shower.

Figure 6A:
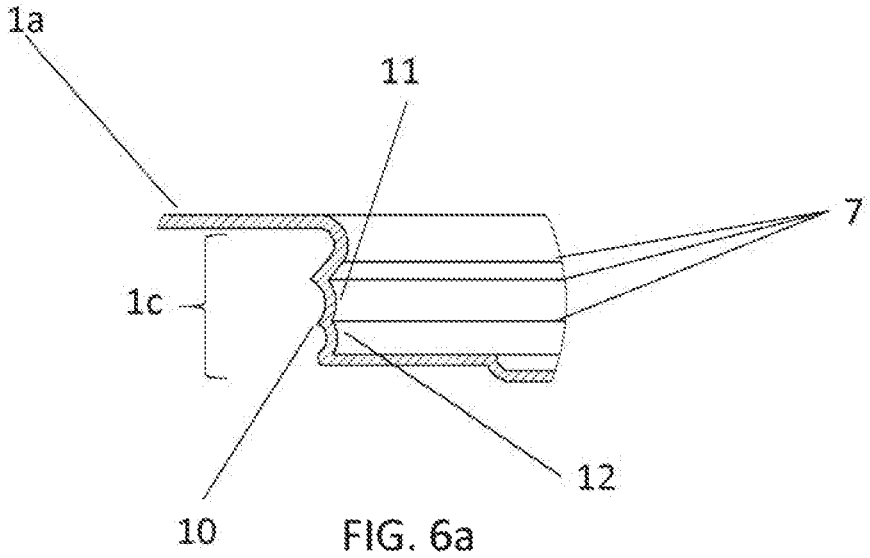
FIGS. 6*a*, 6*b* and 6*c* show partial cross-sectional elevation views of three embodiments of the intermediate section of the adaptive device in an extended state.
Figure 6B:
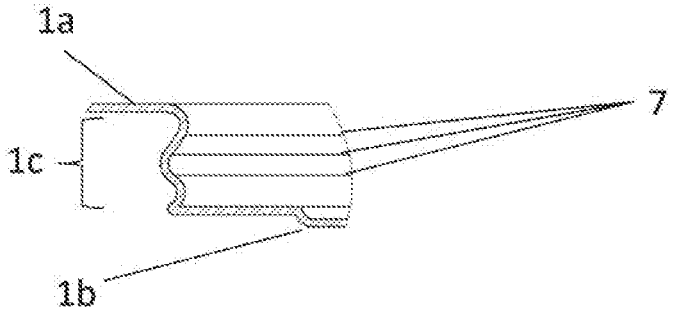
Figure 6C:
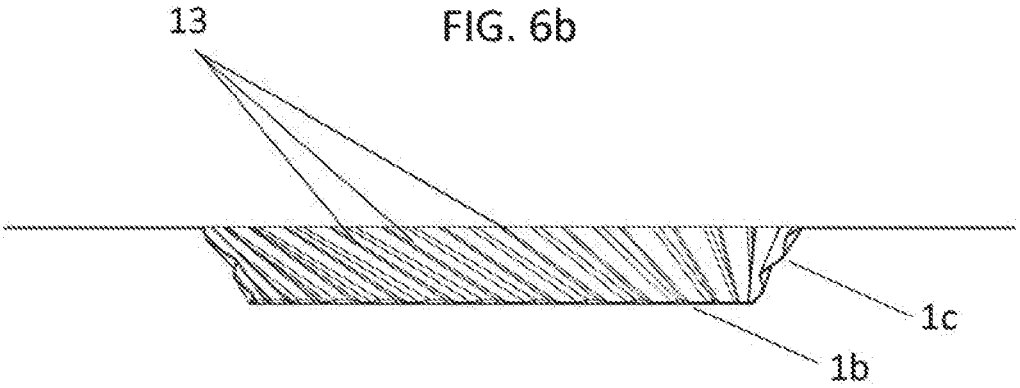
Figure 7:
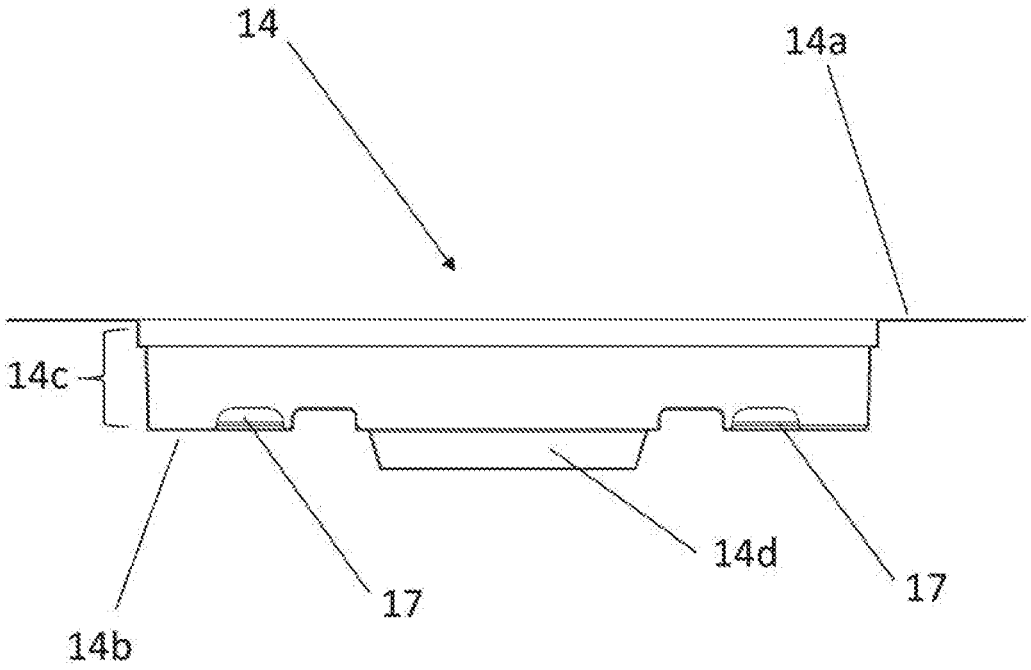
FIG. 7 shows a cross-sectional elevation view of a template piece according to the invention.

FIGS. 6*a* to 6*c* show different configurations which the intermediate section 1*c* may adopt, wherein in FIG. 6*c*, fold lines 13 extend from the lower edge of the intermediate section 1*c* in a curved trajectory in the direction of the upper edge of said intermediate section 1*c*.

Furthermore, the assembly includes a template piece 14 envisaged for being arranged on a clamping ring 3, which comprises a body of a rigid material which has an upper surface 14*a* and a lower surface 14*b* with a central through hole 14*d*, the surfaces being separable from one another, the upper 14*a* and lower 14*b* surfaces joined together by means of an intermediate section 14*c*, the lower surface 14*b* having a plurality of protuberances 16, 17, in which at least one of the protuberances has a through hole. The clamping ring 3 includes a plurality of holes 3*b* radially distributed, envisaged to allow the passage of screw elements 4.

It is noteworthy that the adaptive device 1 and the template piece are axially aligned with respect to the drain body 2 and the clamping ring 3.

The body of the adaptive device 1 is made of a waterproofing laminar material and has a generally circular plan.

Returning to the template piece 14, the protuberances 16, 17 of the template piece 14 are arranged in two assemblies, radially distributed with respect to the central through hole.

Moreover, the template piece 14 includes a pair of perforated pre-cut lines 18, 19, the pre-cut line 18 arranged in the peripheral area of the lower section while the pre-cut line 19 is located on the central part of the lower surface 14*b* of the template 14.

Figure 2:
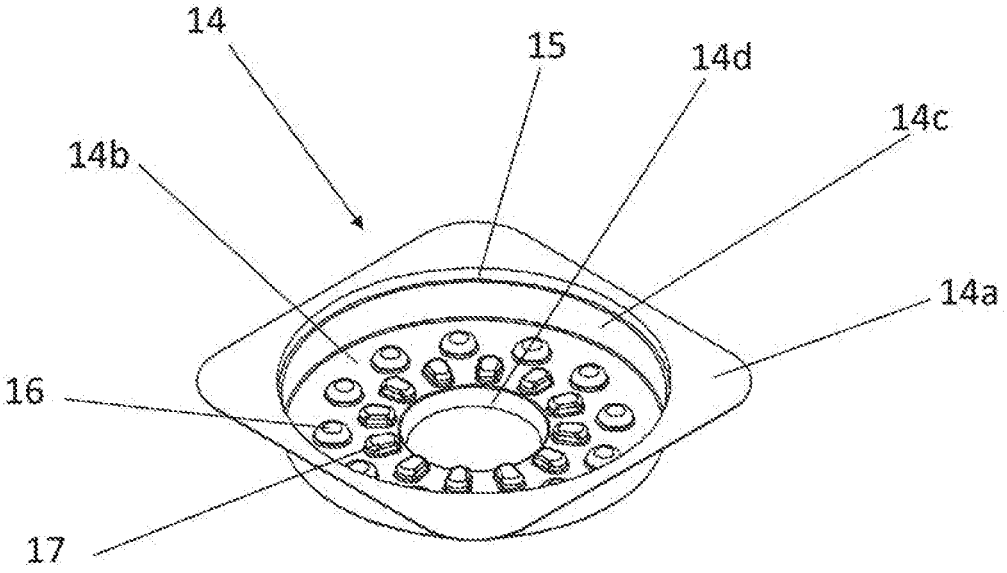
FIG. 2 shows a perspective view of a template piece.
Figure 3:
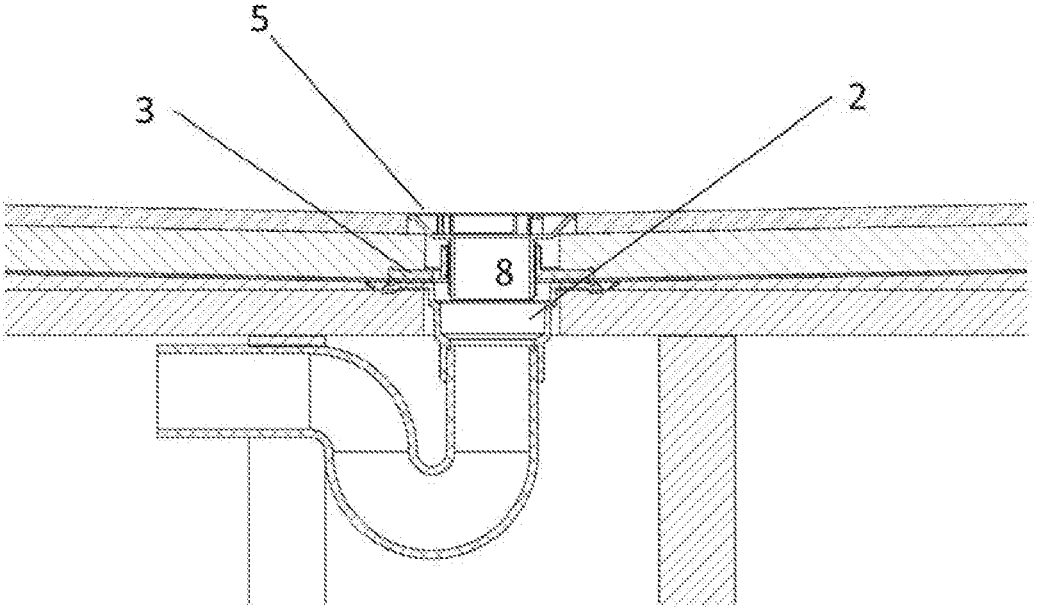
FIG. 3 shows a cross-sectional elevation view of a drain area of a shower tray with a waterproofing system of the prior art.
Figure 4A:
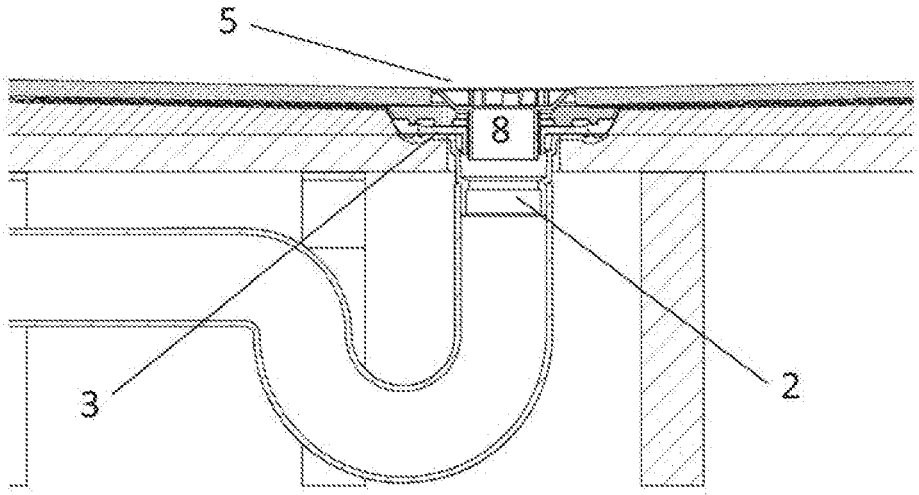
FIGS. 4*a* and 4*b* show schematic views of the waterproofing assembly mounted on two different constructive structures of a shower tray, a wood floor in FIG. 4*a*, and a cement floor in FIG. 4*b;*
Figure 4B:
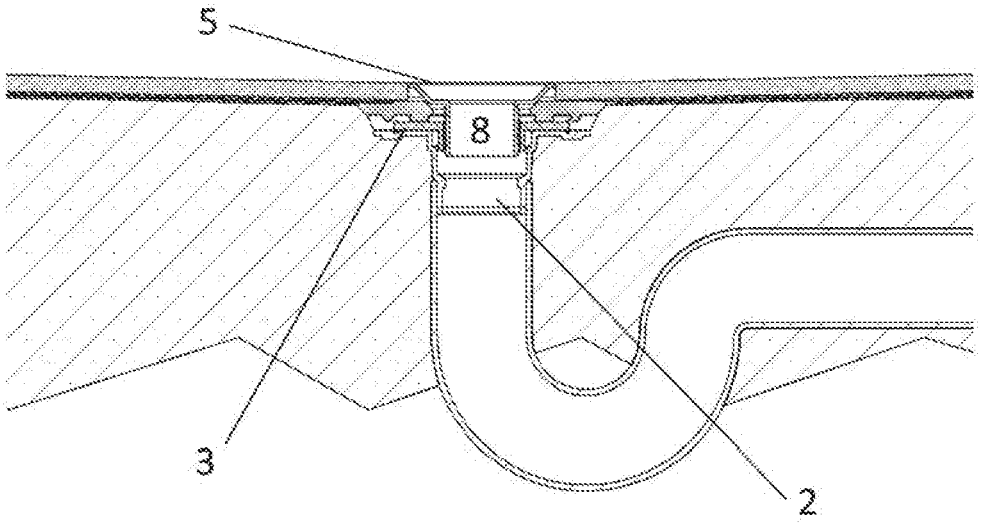
Figure 5A:
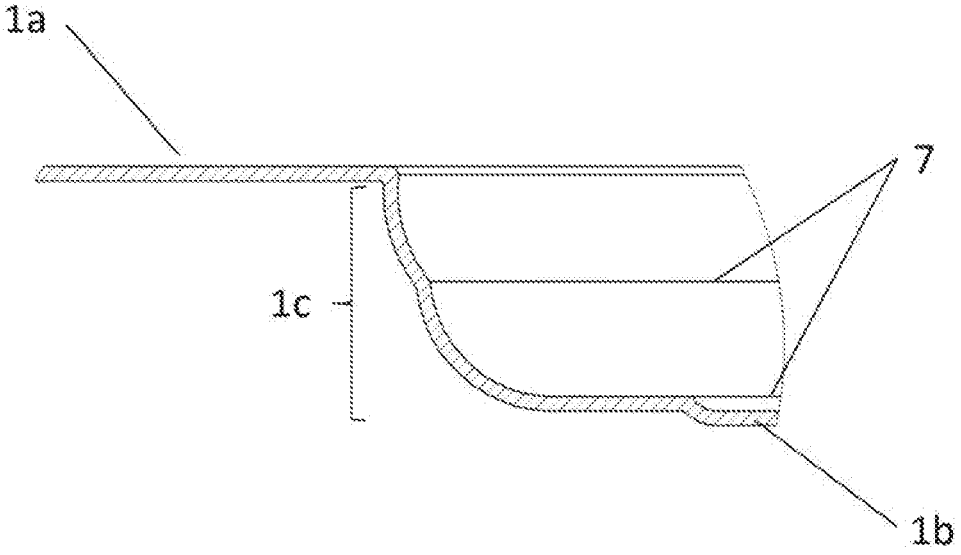
FIGS. 5*a* and 5*b* are partial elevation views of an adaptive device according to the invention in an extended state and in a retracted state, respectively.
Figure 5B:
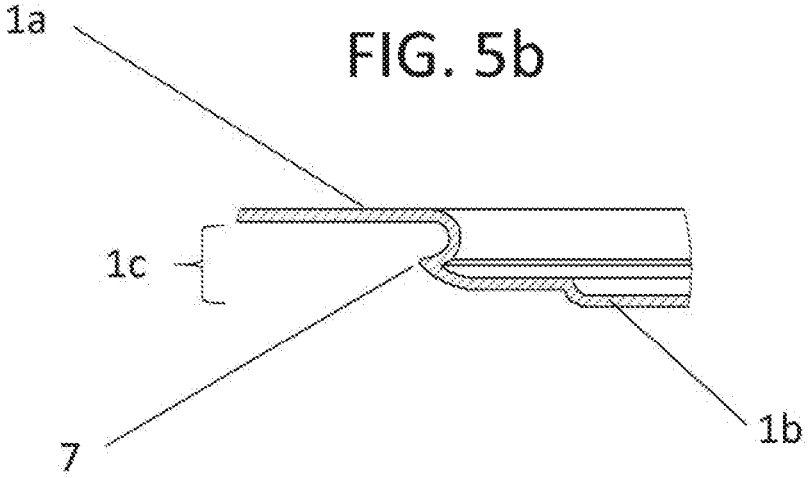

Additionally, the intermediate section 14*b* of the template piece 14 includes a marking line 15, which is shown in FIG. 2.

Advantageously, each of the protuberances 16 of the first set of protuberances has a circular plan and includes a through hole, through which screw elements 4 may pass, while the protuberances 17 have a generally oblong form.

Figure 8:
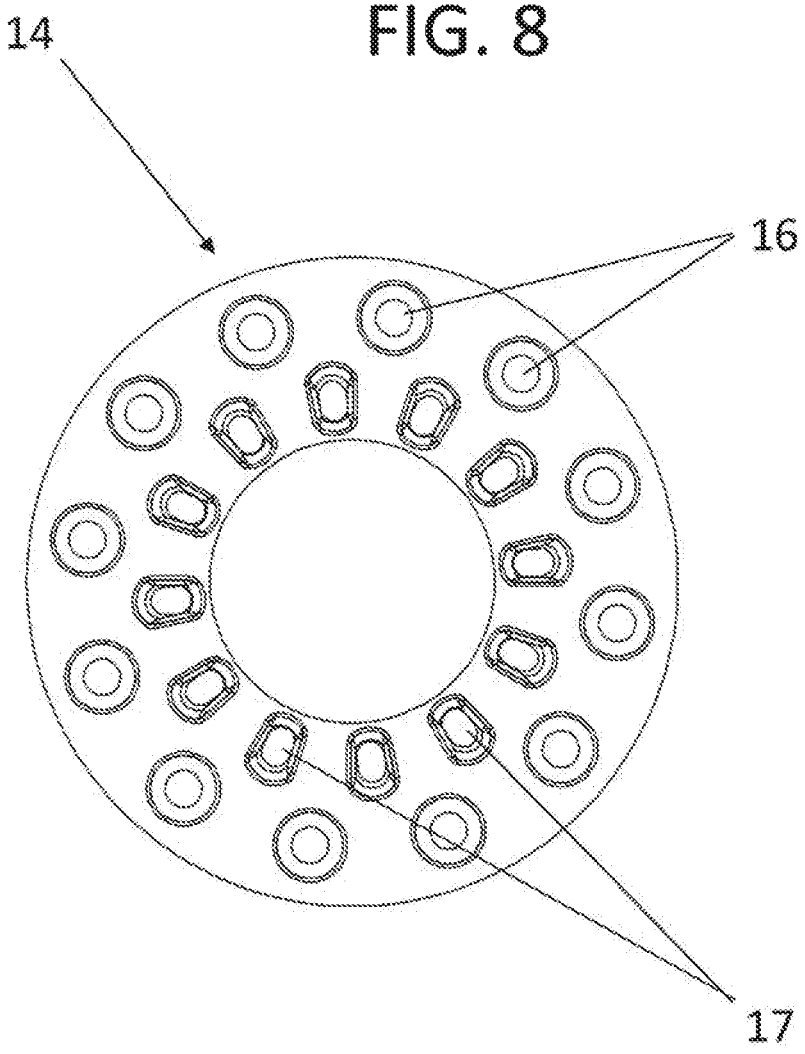
FIG. 8 shows an elevation view of the lower surface of the template piece according to the invention.
Figure 9:
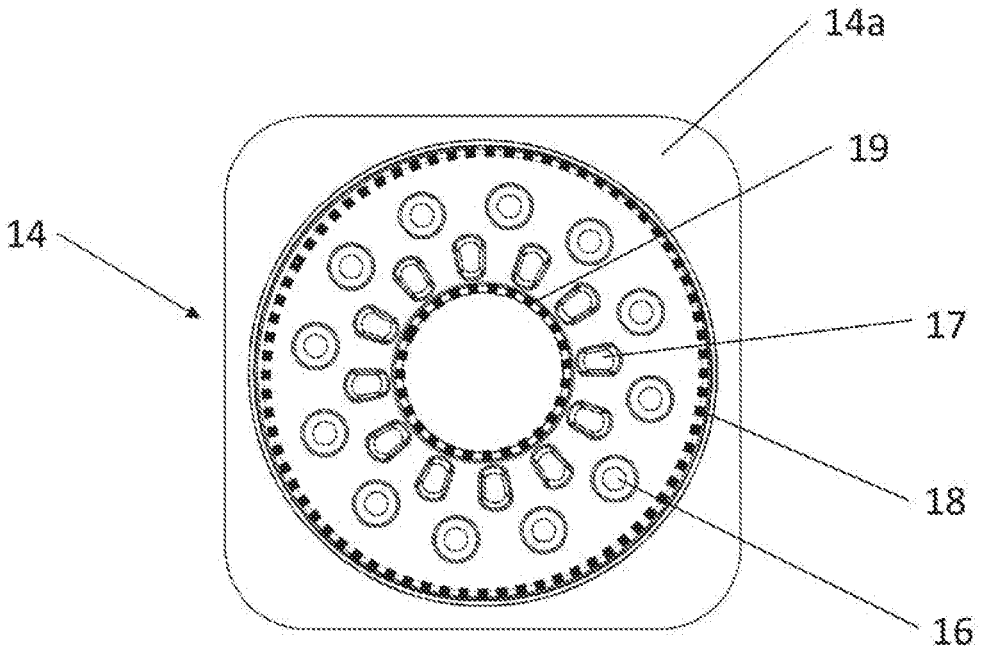
FIG. 9 shows an elevation view of the template piece according to the invention, wherein the pre-cut lines are shown.

As can be seen with greater clarity in FIGS. 8 and 9, the lower surface 14*b* of the template piece 14 has a circular plan.

As can be seen in FIG. 9, the upper surface of the template piece 14 has an essentially quadrangular plan.

Figure 10:
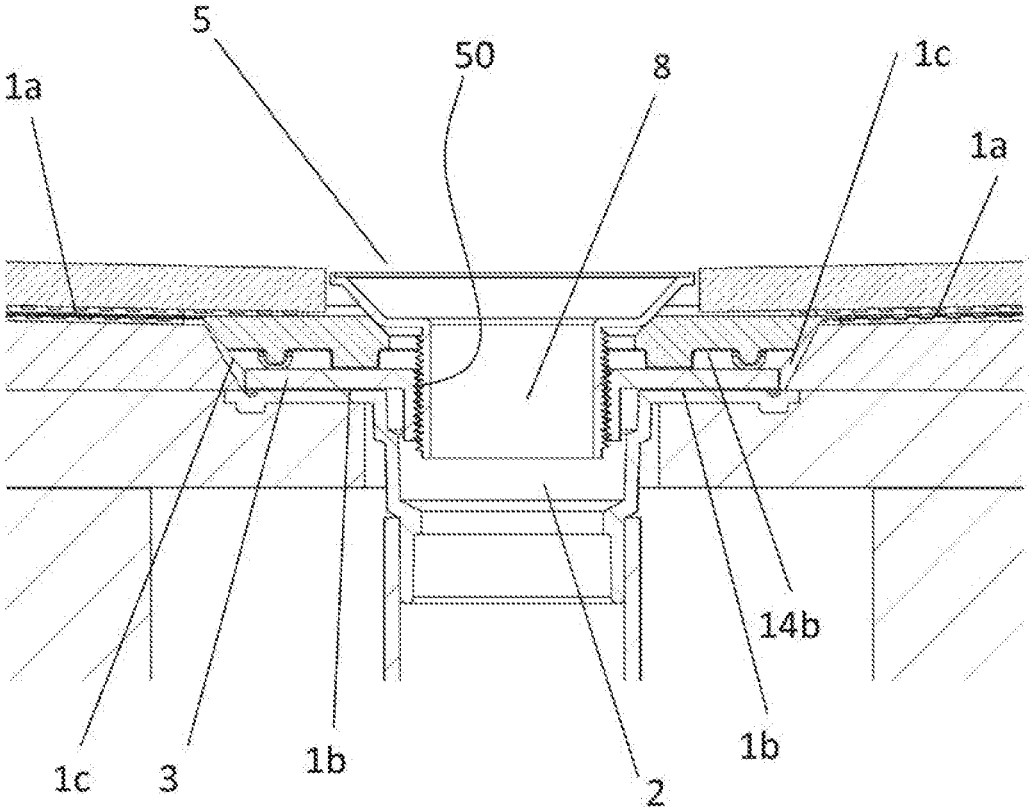
FIG. 10 shows a schematic cross-sectional view of the waterproofing assembly according to the invention installed in a drain area of a built-in shower.

As can be seen in FIG. 10, the clamping ring is coupled to the template piece and the drain body by means of screw elements which pass through protuberances of the template piece.

The details, shapes, dimensions and other accessory elements used to manufacture the device and assembly of the invention may be suitably substituted for others which do not diverge from the scope defined by the claims included below.

What is claimed is:

1. A waterproofing assembly for a built-in shower drain which comprises:

An upper grate,

A drain body,

A clamping ring placed between the upper grate and the drain body, an adaptive device configured to connect a waterproofing to a built-in shower drain, placed between the upper grate and the drain body, which comprises a body made up of an upper section with a through hole and a lower section with a through hole in parallel arrangement at different levels, the upper and lower sections joined together by means of a deformable intermediate section which is capable of folding by means of at least one fold line; and A template piece configured to be placed on the clamping ring, which comprises a body of a rigid material which has an upper surface and a lower surface with a central through hole, the surfaces being separable from one another, the upper and lower surfaces joined together by means of an intermediate section, the lower surface having a plurality of protuberances, in which at least one of the protuberances has a through hole, the adaptive device and the template piece being axially aligned with respect to a drain body and the clamping ring.

2. The waterproofing assembly according to claim 1, wherein the protuberances of the template piece are arranged in two sets, radially distributed with respect to the central through hole.

3. The waterproofing assembly according to claim 1, wherein the template piece includes at least a perforated pre-cut line arranged in the peripheral area of the lower section.

4. The waterproofing assembly according to claim 1, wherein the template piece includes at least an additional perforated pre-cut line located in the upper section.

5. The waterproofing assembly according to claim 1, wherein the intermediate section of the template piece includes at least a marking line.

6. The waterproofing assembly according to claim 1, wherein each of the protuberances of a first set of protuberances comprises a through hole.

7. The waterproofing assembly according to claim 1, wherein the lower surface of the template piece has a circular plan.

8. The waterproofing assembly according to claim 1, wherein the upper surface of the template piece has a quadrangular, plan.

9. The waterproofing assembly according to claim 1, wherein the clamping ring is coupled to the template piece and the drain body by means of screw elements which pass through protuberances of the template piece.

10. In a waterproofing assembly for a built-in shower drain, that drains water coming from a shower tray, with an upper grate connectable to said shower tray, and a drain body with a mouth, the drain body configured to be housed in a drainage hole, and a clamping ring placed between the upper grate and the drain body and configured to be fastened to said upper grate and said drain body, an improvement comprising:

an adaptive device for connecting the waterproofing assembly and the built-in shower drain as well as to be placed between the drain body and the clamping ring, the adaptive device comprising a body made up of an upper section joined to a lower section by means of a deformable intermediate section which is capable of folding by means of at least one fold line; and a template piece configured to be placed on the clamping ring having an upper surface and a lower surface with a central through hole, the upper and lower surfaces joined together by means of an intermediate section, the lower surface having a plurality of protuberances, in which at least one of the protuberances has a through hole, and the template piece includes at least a perforated pre-cut line arranged in the peripheral area of the lower section:

wherein the adaptive device and the template piece are axially aligned with respect to the drain body and the clamping ring.

11. The improvement according to claim 10, wherein the intermediate section of the adaptive device comprises at least three folding lines parallel to each other.

12. The improvement according to claim 10, wherein the body has a circular plan.

13. The improvement according to claim 10, wherein the body is made up of a laminar material of waterproofing material.

14. The improvement according to claim 10, wherein the protuberances of the template piece are arranged in two sets, radially distributed with respect to the central through hole.

* * * * *